US007295095B2

(12) United States Patent
Suzui

(10) Patent No.: US 7,295,095 B2
(45) Date of Patent: Nov. 13, 2007

(54) ELECTRIC COMPONENT AND METHOD OF PRODUCING THE SAME

(75) Inventor: Masaki Suzui, Tochigi (JP)

(73) Assignee: Canon Kabushiki Kaisha, Tokyo (JP)

( * ) Notice: Subject to any disclaimer, the term of this patent is extended or adjusted under 35 U.S.C. 154(b) by 200 days.

(21) Appl. No.: 10/834,890

(22) Filed: Apr. 30, 2004

(65) Prior Publication Data

US 2004/0222874 A1 Nov. 11, 2004

(30) Foreign Application Priority Data

May 9, 2003 (JP) ..... 2003-132155

(51) Int. Cl.
*H01F 5/00* (2006.01)

(52) U.S. Cl. ..... 336/200

(58) Field of Classification Search ..... 336/83, 336/192, 198, 200, 220–223, 232
See application file for complete search history.

(56) References Cited

U.S. PATENT DOCUMENTS

| | | | | |
|---|---|---|---|---|
| 4,112,481 | A | 9/1978 | Roge et al. | 361/395 |
| 5,093,646 | A | 3/1992 | Herbert | 336/225 |
| 5,585,773 | A | 12/1996 | Murata et al. | 336/90 |
| 5,589,006 | A | 12/1996 | Itoyama et al. | 136/248 |
| 5,805,431 | A | 9/1998 | Joshi et al. | 361/836 |
| 5,849,107 | A | 12/1998 | Itoyama et al. | 136/248 |
| 6,066,797 | A | 5/2000 | Toyomura et al. | 136/251 |
| 6,093,884 | A | 7/2000 | Toyomura et al. | 136/244 |
| 6,207,889 | B1 | 3/2001 | Toyomura et al. | 136/244 |
| 6,245,987 | B1 | 6/2001 | Shiomi et al. | 136/244 |
| 6,657,118 | B2 | 12/2003 | Toyomura et al. | 136/244 |
| 6,734,775 | B2 * | 5/2004 | Chung | 336/198 |
| 6,753,692 | B2 | 6/2004 | Toyomura et al. | 324/718 |
| 6,791,024 | B2 | 9/2004 | Toyomura | 136/251 |
| 6,927,667 | B1 * | 8/2005 | Busletta et al. | 336/208 |
| 2003/0210562 | A1 | 11/2003 | Takahara et al. | 363/24 |
| 2004/0159102 | A1 | 8/2004 | Toyomura et al. | 60/641.8 |
| 2004/0174240 | A1 | 9/2004 | Suzui | 336/150 |
| 2004/0183642 | A1 | 9/2004 | Suzui | 336/192 |
| 2004/0222873 | A1 | 11/2004 | Toyomura | 336/182 |
| 2004/0223351 | A1 | 11/2004 | Kurokami et al. | 363/65 |
| 2004/0246087 | A1 | 12/2004 | Suzui | 336/182 |

FOREIGN PATENT DOCUMENTS

| | | |
|---|---|---|
| EP | 0 218 846 A1 * | 4/1987 |
| GB | 2 291 736 A | 1/1996 |
| JP | 06-069035 | 3/1994 |
| JP | 2547442 | 5/1997 |
| JP | 2001-237126 | 8/2001 |
| WO | WO89/10621 | 11/1989 |

* cited by examiner

*Primary Examiner*—Tuyen T Nguyen
(74) *Attorney, Agent, or Firm*—Fitzpatrick, Cella, Harper & Scinto

(57) ABSTRACT

In a push-pull switching circuit for a low-voltage, large current application, a decrease in resistance of a transformer and of its peripheral circuit is sought for. In view of this, a coil (2) is fixed at its terminal (T1) side, and is wound around a columnar winding core (1) counterclockwise in the order of a lower surface (H), side surface (I), upper surface (J), side surface (K), and the lower surface (H). A coil (3) is fixed at its terminal (T4) side, and is wound clockwise in the order of the upper surface (J), side surface (I), lower surface (H), side surface (K), and upper surface (J).

6 Claims, 21 Drawing Sheets

ELECTRIC COMPONENT AND METHOD OF PRODUCING THE SAME

FIELD OF THE INVENTION

The present invention relates to an electric component and a method of producing the same and, more particularly, to an electric component such as a transformer or inductor used in a power supply circuit or the like.

BACKGROUND OF THE INVENTION

In recent years, along with a decrease in power supply voltage and an increase in capacity of information devices, the voltage and current of a switching power supply tend to decrease and increase, respectively.

FIG. 1 is a view showing the typical arrangement of a transformer used in the switching power supply, and is disclosed in, e.g., Japanese Patent Laid-Open No. 6-069035. In the transformer as shown in FIG. 1, coils are wound around a columnar winding core made of an electrical insulating material. After that, in order to reliably fix the coils, so-called taping is performed, that is, the coils are fixed to the columnar winding core entirely or partly by using adhesive tapes or the like.

In a transformer for a low-voltage, large-current power supply, it is significant to decrease the resistances of the coils, and accordingly the number of turns of each coil must be decreased. If the number of turns is one, since it is very difficult to maintain this one turn by only the coil itself, taping described above becomes important. Taping, however, takes up the winding space of the columnar winding core, and accordingly a columnar winding core having a large winding width is required, resulting in an increase in size of the transformer. In addition, the complicated process of taping increases the cost of the transformer.

Pin terminals to which the two ends of each coil are to be connected are generally arranged in the vicinities of the two end faces of the columnar winding core. Therefore, after the coil is wound, its ends are extracted in directions largely different from the winding direction. For example, when a plurality of coils are to be wound around the columnar winding core, the extracting portions of one coil may come in contact with other coils to further take up the winding space. Thus, the coil winding operation becomes complicated. In particular, for example, when a transformer for a low-voltage, large-current application is to use an electric wire with a large wire diameter, the electric wire is rigid and is difficult to wind, making the operation much more difficult.

When a plurality of electric wires are to be wound around a columnar winding core parallel to each other, a coil which is to be wound at a position farther from the corresponding pin terminals has longer extracting portions. In particular, when the coil has a small number of turns, e.g., one turn, the proportion of the lengths of the extracting portions in the entire length of each coil generally becomes large, and the differences in entire lengths among the respective coils become obvious. Therefore, even when the number of parallel turns of each coil is increased, the resistance of the coil is not decreased so much for the number of parallel turns, and the values of currents flowing through the respective coils differ.

In order to solve these problems, the present applicant has proposed a circuit board with an inductor or transformer (to be sometimes merely referred to as a "transformer" hereinafter) having an arrangement as shown in FIG. 2. FIG. 2 is a plan view of a circuit board with a transformer. One set of coils 6 and 7 are wound around a columnar winding core parallel to each other in one direction, and their ends are connected to lands (output terminals) on the circuit board. The ends of a secondary coil 8 are connected to the pin terminals of a bobbin. With this arrangement, the entire lengths of one set of primary coils can be set almost equal to each other. In the following description, reference numerals Tx (x is a figure) in the drawings represent terminal numbers of a transformer or the like.

In further research of the present inventor, of the ends of the respective coils, those which have different polarities must be arranged close to each other in order to decrease the resistance of a transformer having one set of coils wound around a columnar winding core or the resistance of its peripheral circuit portion. FIG. 3 is a view for explaining the reason for this.

FIG. 3 is a view showing a push-pull switching circuit. A transformer 9 having the arrangement shown in FIG. 2 includes a primary coil (formed of one set of series-connected coils 6 and 7) and the secondary coil 8. The connection point where the opposite-polarity ends of the coils 6 and 7 are connected forms the center tap (CT) of the primary coil. A terminal T1 of the transformer 9, to which one end (non-CT side) of the coil 6 is connected, is connected to the drain electrode of a switching element SW1. Similarly, a terminal T4 of the transformer 9, to which one end (non-CT side) of the coil 7 is connected, is connected to the drain electrode of a switching element SW2. Terminals T2 and T3 of the transformer 9 which form the CT are connected to the positive side of a DC power supply E. The two source terminals of the switching elements SW1 and SW2 are connected to the negative side of the DC power supply E. Thus, a push-pull switching circuit is formed.

An output from the coil 8 as the secondary coil of the transformer 9 is full-wave rectified by, e.g., a diode bridge D1–D4, and is output to the output terminal of the circuit shown in FIG. 3. Generally, capacitors C1 and C2 are connected to the input/output terminals of the circuit shown in FIG. 3, when necessary, in order to suppress fluctuations in the DC voltage. Although a MOSFET is used as a switching element in FIG. 3, the type of the switching element is not particularly limited.

In this push-pull switching circuit, the source electrodes of the switching elements SW1 and SW2 and the terminals T2 and T3 of the transformer 9 which form the CT are desirably arranged close to each other, so that the resistances of the wiring lines among the respective elements may be decreased (FIG. 2 shows general arrangement of the switching elements SW1 and SW2). This demand is strong particularly in a push-pull switching circuit for a low-voltage, large-current application.

Therefore, a decrease in resistance of an electric component and of its peripheral circuit is sought for.

SUMMARY OF THE INVENTION

According to the first aspect of the present invention, there is disclosed a transformer to be used together with a printed-circuit board, which comprises a winding core, a first coil wound around the winding core, and a second coil wound around the winding core in a direction opposite to the first coil, wherein different-polarity ends of the first and second coils are extracted on one side of the winding core.

In the transformer having coils with this arrangement, the different-polarity ends of the first and second coils are arranged on the side of one side surface of the winding core.

Accordingly, the distance between those ends of the coils which form a center tap is decreased. Switching elements are arranged in the vicinities of other ends of the coils, so that the distance between the switching elements can be decreased. As a result, the resistance of the transformer and that of the conductor pattern of its peripheral circuit can be decreased.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

A transformer according to an embodiment of the present invention will be described. Note that the present invention can be applied not only to a transformer but also to a magnetic component such as an inductor.

Figure 1:
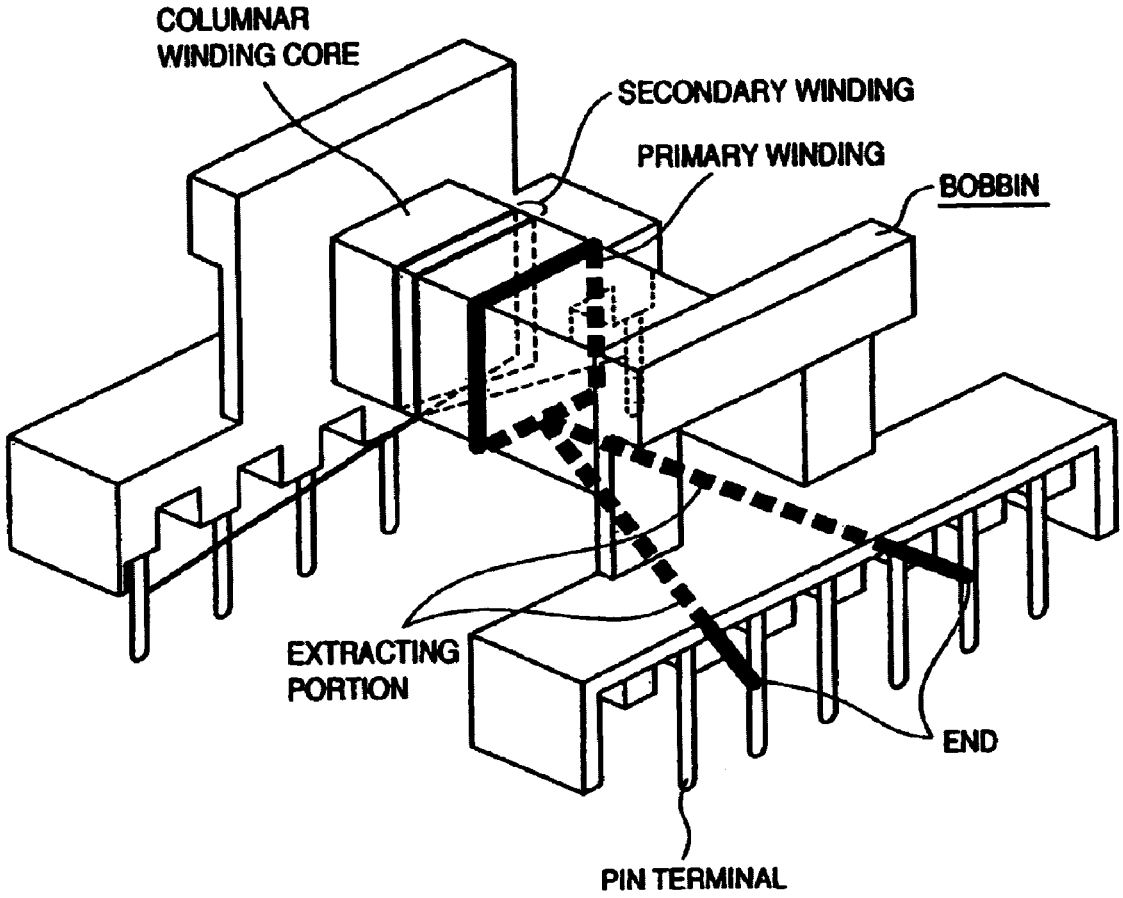
FIG. 1 is a view showing the typical arrangement of a transformer used in a switching power supply.
Figure 2:
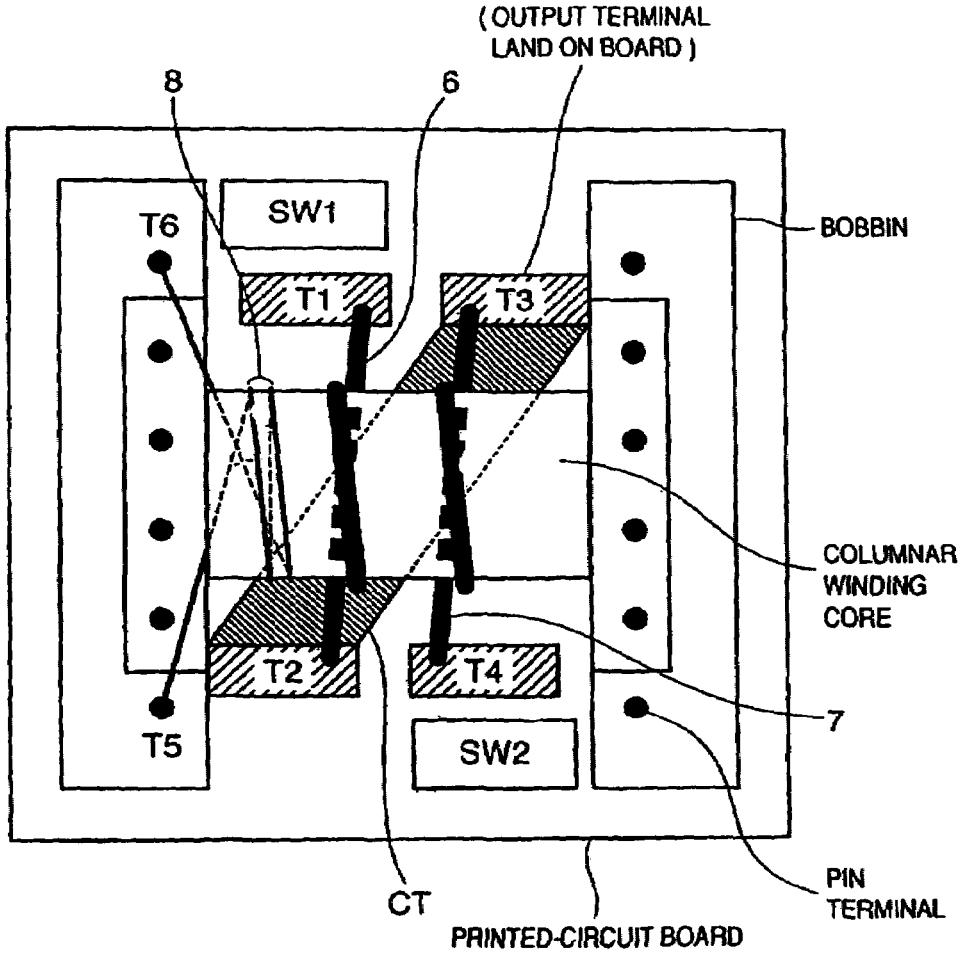
FIG. 2 is a view showing a printed-circuit board with a transformer.
Figure 3:
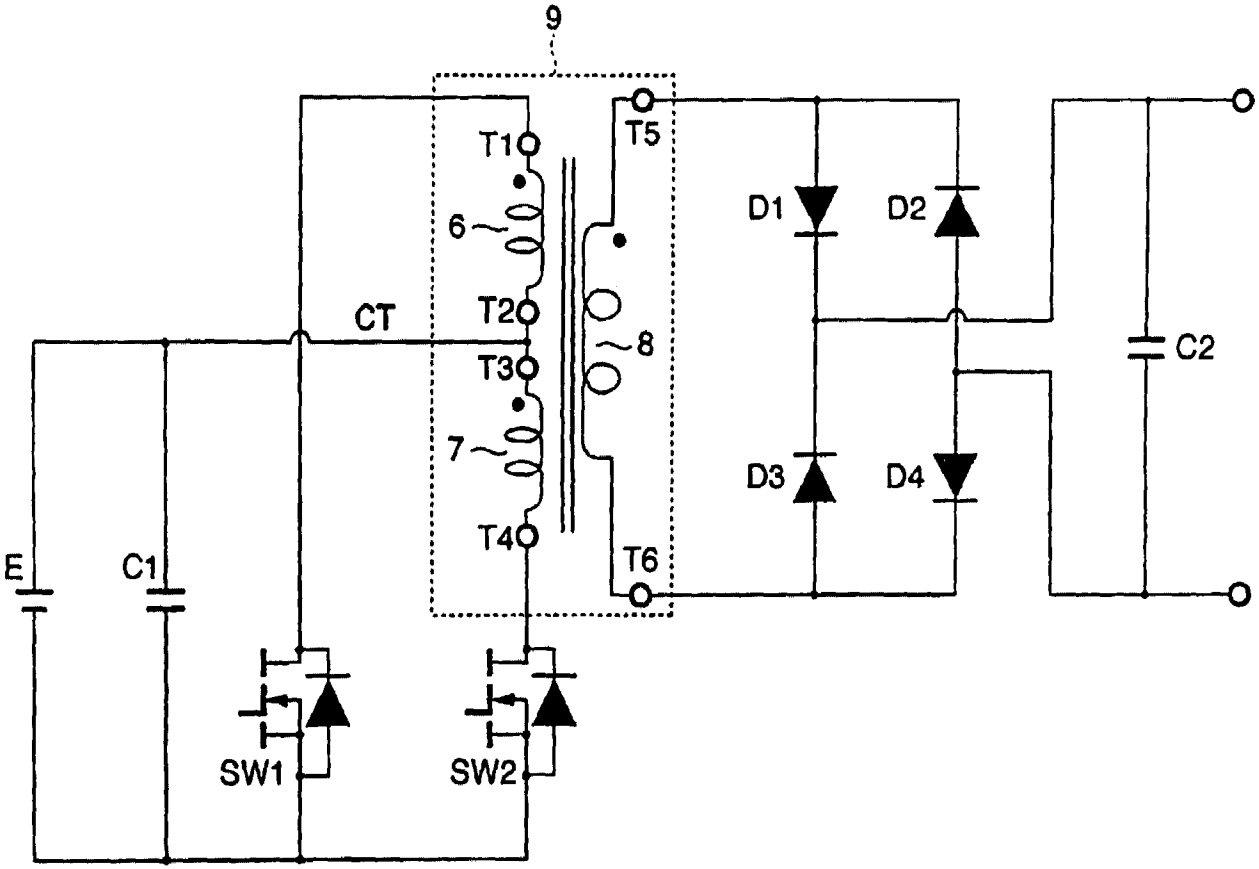
FIG. 3 is a circuit diagram showing a push-pull switching circuit.
Figure 4:
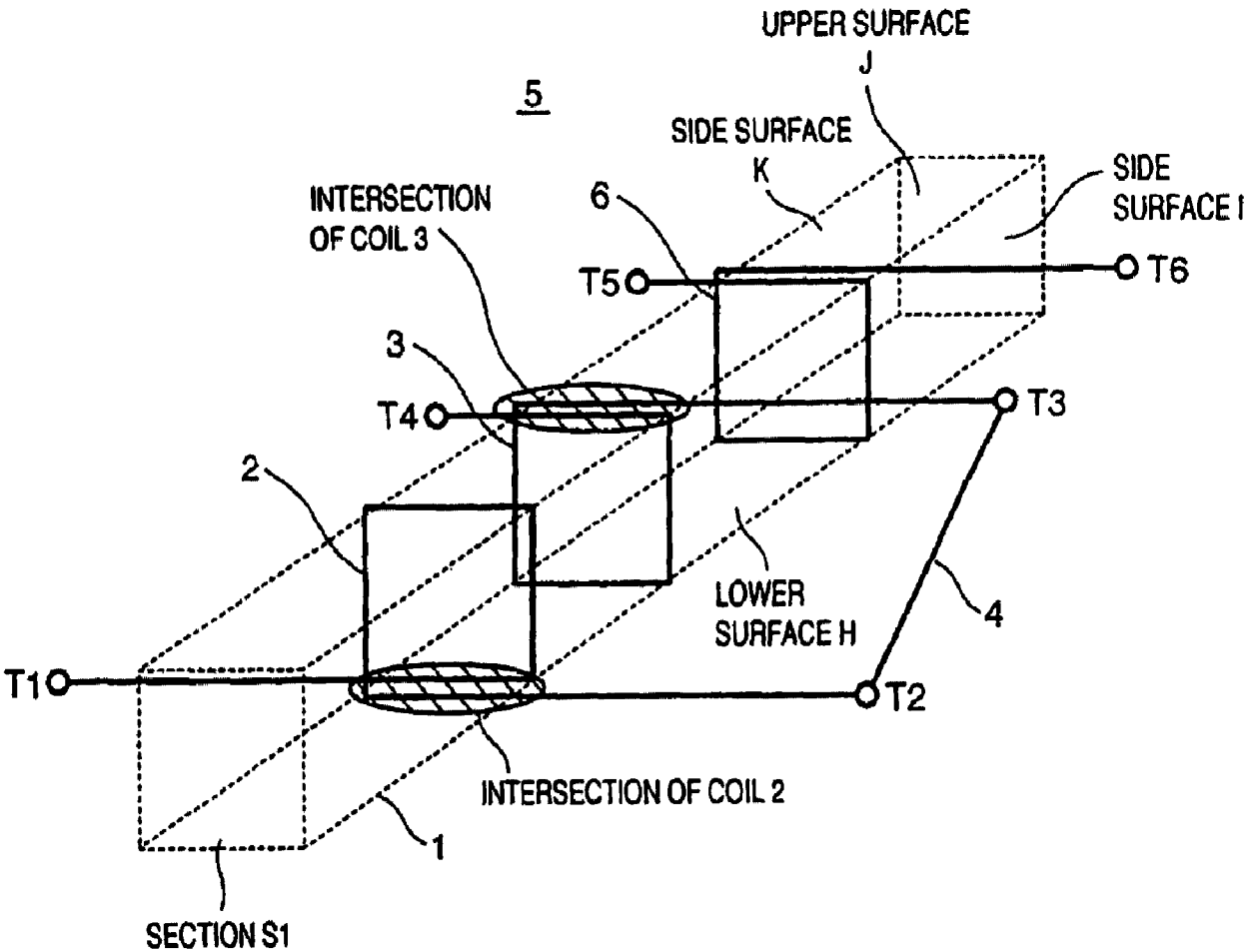
FIG. 4 is a conceptual view for explaining a method of winding coils according to an embodiment.

FIG. 4 is a conceptual view for explaining a method of winding coils of a transformer 5 according to this embodiment. The transformer 5 includes a columnar winding core 1 around which the coils are to be wound, coils 2 and 3 having the same arrangement as that of one set of coils 6 and 7 shown in FIGS. 2 and 3, a conductive bar 4 (e.g., a round or square copper bar or a copper plate) to connect terminals T2 and T3, and a secondary coil 6 having terminals T5 and T6. The columnar winding core 1 has a prismatic shape with a rectangular section S1, and its upper surface J and side surfaces I and K are defined as shown in FIG. 4. A surface which opposes the upper surface J is defined as a lower surface H.

Figure 5A:
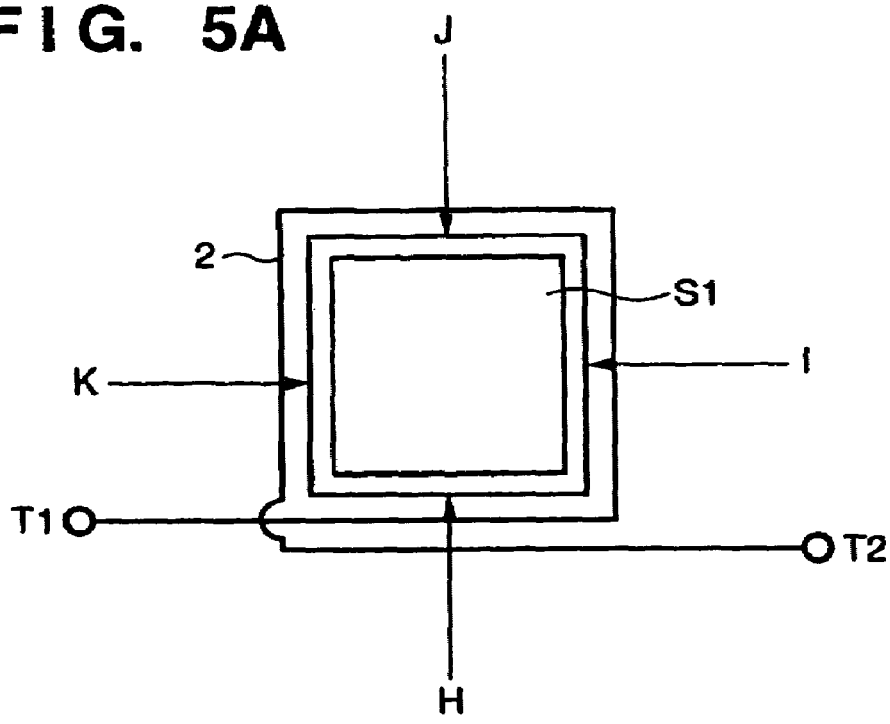
FIGS. 5A and 5B are views each for explaining the method of winding the coil when seen from a sectional side.
Figure 5B:
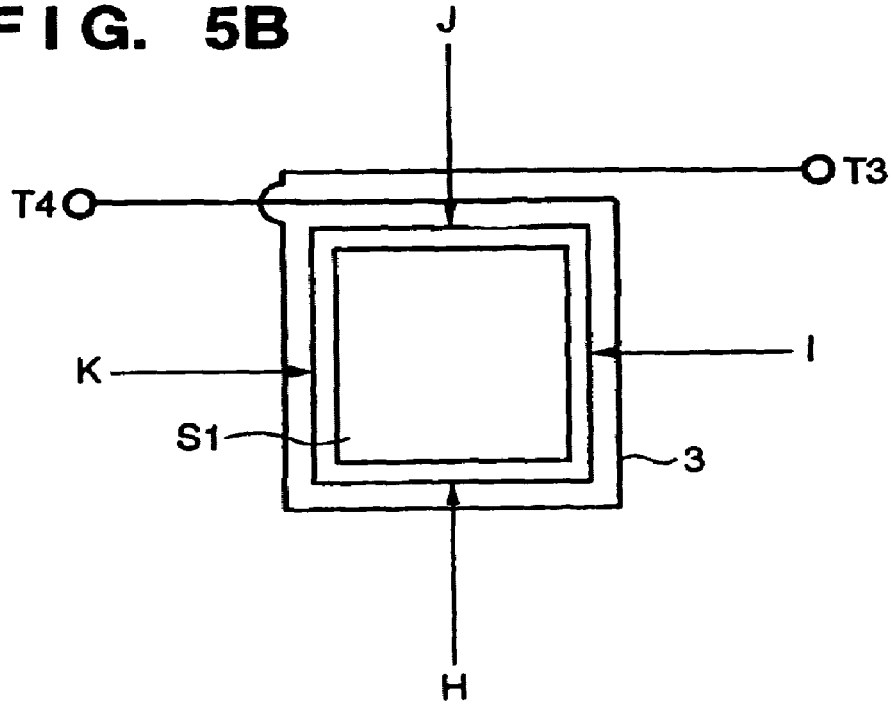

FIGS. 5A and 5B are views for explaining a method of winding the coils 2 and 3 when seen from the side of the section S1.

As shown in FIGS. 5A and 5B, the coil 2 is fixed at its terminal T1 side, and is wound around the columnar winding core 1 counterclockwise in the order of the lower surface H, side surface I, upper surface J, side surface K, and lower surface H. The coil 3 is fixed at its terminal T4 side, and is wound clockwise in the order of the upper surface J, side surface I, lower surface H, side surface K, and upper surface J. With this operation, the different-polarity terminals T1 and T4 of the coils 2 and 3 are arranged on the side of one side surface of the columnar winding core 1, and the different-polarity terminals T2 and T3 of the coils 2 and 3 are arranged on the side of the other side surface of the columnar winding core 1. Accordingly, the distance between the terminals T2 and T3 that form the CT is decreased. Switching elements SW1 and SW2 (see FIG. 3) are arranged in the vicinities of the terminals T1 and T4. Thus, the distance between the source electrodes of the switching elements SW1 and SW2 can be decreased. Therefore, the resistance of the transformer which uses the coils 2 and 3 and that of the conductor pattern of its peripheral circuit are expected to decrease.

Regarding the coil arrangement of the transformer 5, as shown in FIGS. 4, 5A, and 5B, the intersections (portions where the windings of the respective coils intersect when the coils are to be wound around the columnar winding core 1) of the respective coils are dispersed between the upper and lower surfaces J and H of the columnar winding core 1. Thus, the winding width of the columnar winding core 1 can be utilized more effectively.

Figure 6:
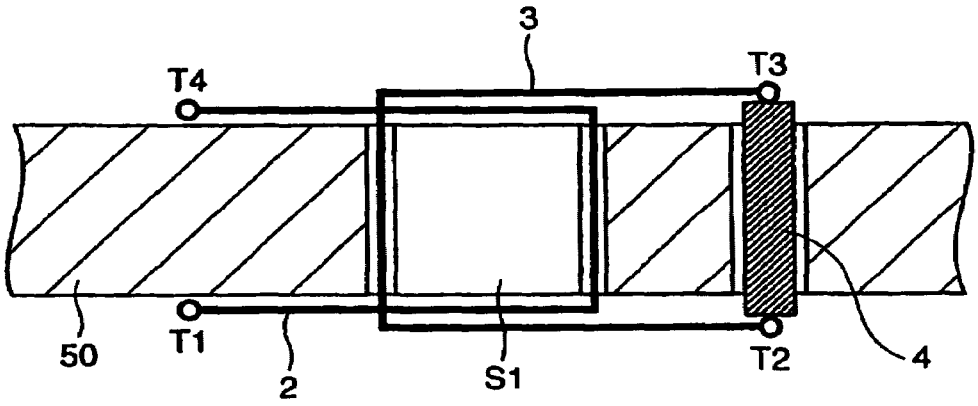
FIG. 6 is a view showing how to bury the transformer in the printed-circuit board.

As shown in FIG. 6, if the transformer which uses the coils 2 and 3 is buried in a printed-circuit board 50, the respective terminals are arranged on the two surfaces of the printed-circuit board 50, contributing to a decrease in profile of the entire circuit. If the transformer is arranged such that its conductive bar 4 is also buried in the printed-circuit board 50, the arrangement of the CT (connection of the terminals T2 and T3) can be soldered with a general packaging technique, and formation of the CT is facilitated very much. The length of the conductive bar 4 can be suppressed to almost the same as the length (length in the direction of thickness of the printed-circuit board 50) of each of the side surfaces I and K of the columnar winding core 1. Thus, the conductive bar 4 which forms the CT can be shortened.

In the above description, the coils are wound around the columnar winding core 1. Alternatively, the coils may be wound around a core directly. The material of the core to be inserted in the bobbin is not particularly limited, and can be a hollow core in an extreme case. In the above description, one set of coils each having one turn are wound. However, the numbers of turns of the coils are not particularly limited. It suffices as far as first and second coils are wound around the columnar winding core 1 in opposite directions, those ends of the two coils which form the CT are extracted on one side surface of the columnar winding core 1, and the other end of each of the two coils is extracted on the opposite side surface of the columnar winding core 1.

First Embodiment

A transformer according to the first embodiment will be described.

Figure 7:
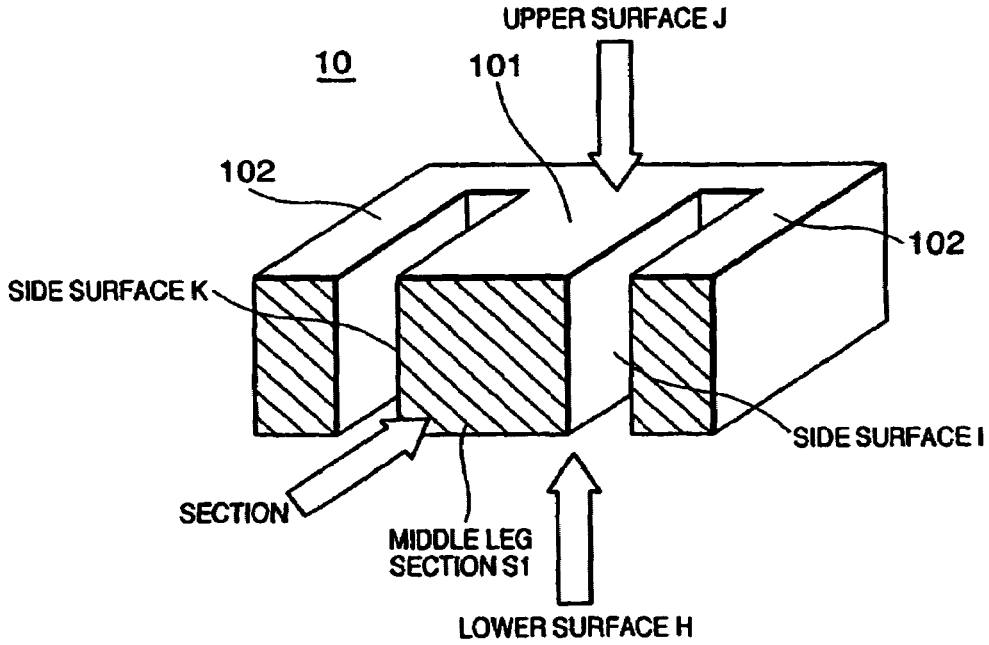
FIG. 7 is a view showing an E-type core.

According to a transformer 13 of the first embodiment, an EE-type core including two E-type cores 10 each shown in FIG. 7 is used, so that the same function as that of the transformer 5 shown in FIG. 4 is realized by coils having the same arrangement as that of the transformer 5 shown in FIG. 4. The coils of the transformer 13 include coils 2 and 3 corresponding to one set of coils of the transformer 5, and a secondary coil 11. As the coils 2 and 3 correspond to the coils 2 and 3 of FIG. 4, a detailed description on a method of winding the coils 2 and 3 will be omitted. Switching elements SW1 and SW2 to realize a push-pull switching circuit, rectifying diodes D1 to D4, smoothing capacitors C1 and C2 to be connected to the input/output of the circuit, and the like are obvious by referring to FIG. 3, and a detailed description thereof will be omitted.

As shown in FIG. 7, the E-type core 10 includes a middle leg 101 around which the coils are mainly wound, and one set of side legs 102 arranged on the two sides of the middle leg 101 to be parallel to it. The faces of the respective legs of the E-type core 10 that are to be bonded to the faces of the respective legs of a counterpart E-type core 10 when forming an EE-type core are defined as the sections of the E-type core 10. Of the sections, the section of the middle leg 101 corresponds to the section of the columnar winding core 1, and will be defined as a middle leg section S1 (to be merely referred to as "section S1" hereinafter). In FIG. 7, an upper surface J and lower surface H of the E-type core 10 are defined with respect to the section of the E-type core 10 as the front surface. In other words, the definitions for the upper surface J and lower surface H and for side surfaces I and K of the middle leg 101 are equal to those for the side surfaces of the columnar winding core 1 of FIG. 4.

Figure 8:
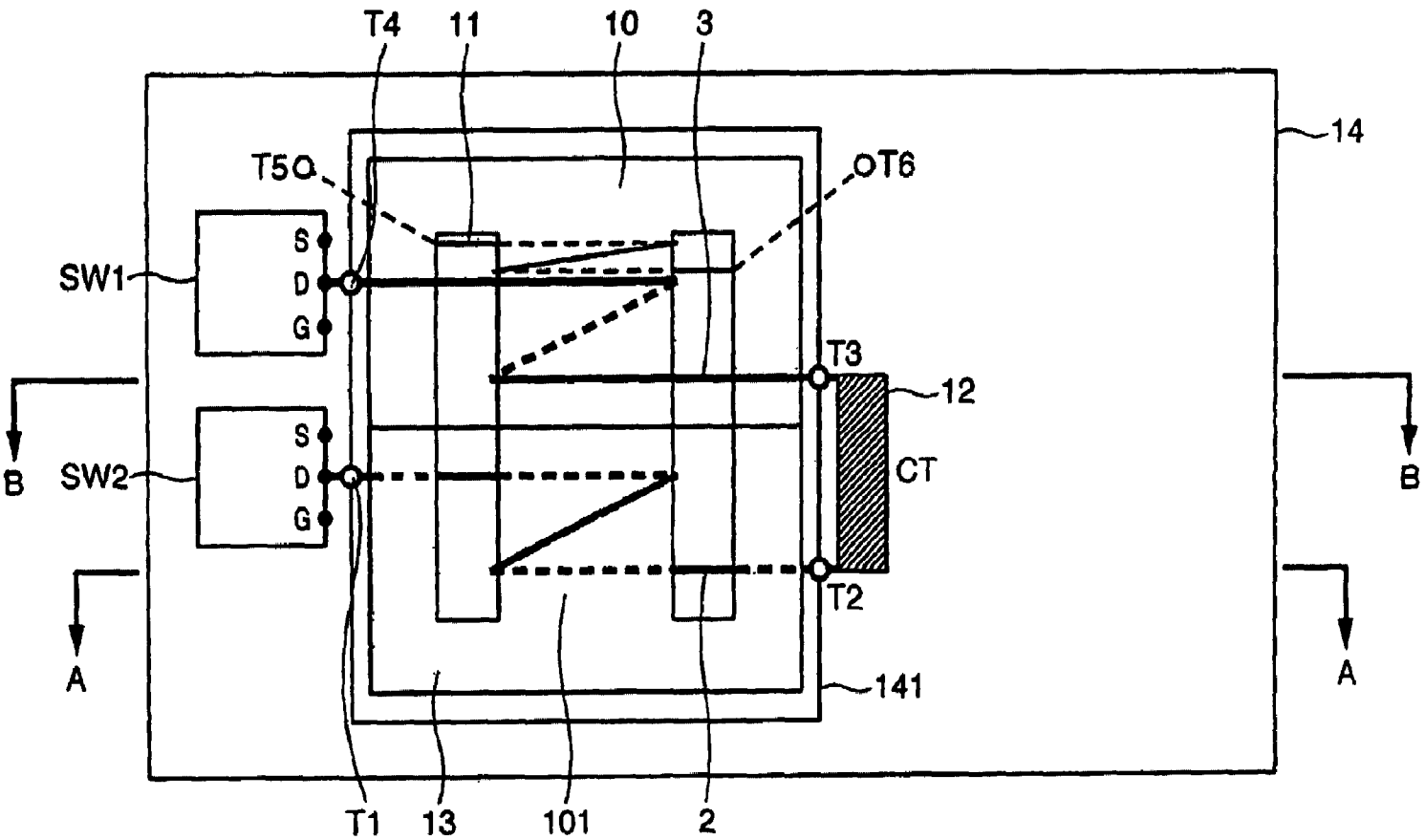
FIG. 8 is a view showing a printed-circuit board including a transformer according to the first embodiment.

FIG. 8 is a plan view of a printed-circuit board 14 including the transformer 13 according to the first embodiment.

The printed-circuit board 14 is a printed-circuit board on which the transformer 13 is to be mounted, and has an opening 141 through which the EE-type core 10 is to be inserted, and an insertion hole for a conductive bar 12 which forms the CT of the transformer 13. Lands and conductive patterns to connect the respective terminals of the transformer 13 to the switching elements and conductive bar 12 are also formed on the printed-circuit board 14 when necessary.

Figure 9:
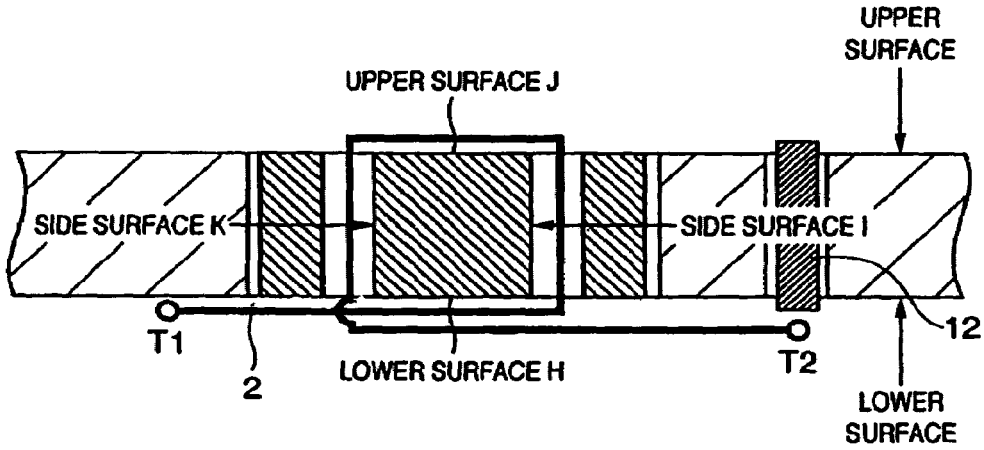
FIGS. 9 and 10 are views each for explaining a method of winding a coil when seen from a sectional side.
Figure 10:
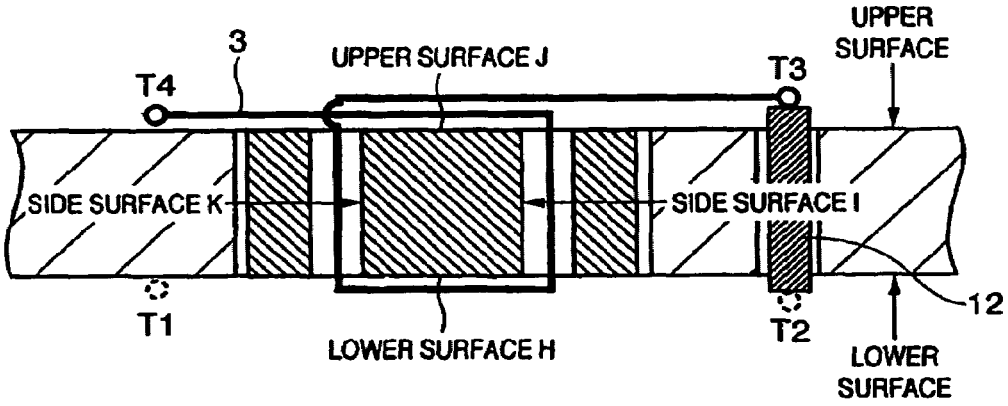

FIGS. 9 and 10 are sectional views taken along the lines A—A and B—B, respectively, of FIG. 8, and explain a method of winding the coils 2 and 3 when seen from the sectional sides. Note that the E-type cores 10 are inserted in the opening 141 such that their upper surfaces (see FIG. 7) are arranged on the upper surface side of the printed-circuit board 14.

As shown in FIG. 9, the coil 2 is fixed at its terminal T1 side, and is wound counterclockwise in the order of a lower surface H, side surface I, upper surface J, side surface K, and the lower surface H. As shown in FIG. 10, the coil 3 is fixed at its terminal T4 side, and is wound clockwise in the order of the upper surface J, side surface I, lower surface H, side surface K, and upper surface J in the opposite manner to that of FIG. 2.

Consequently, as shown in FIG. 8, the different-polarity terminals T1 and T4 of the coils 2 and 3 are arranged on one side surface of the middle leg 101, and the different-polarity terminals T2 and T3 of the coils 2 and 3 are arranged the other side surface of the middle leg 101. Accordingly, the distance between the terminals T2 and T3 which form the CT is decreased. The switching elements SW1 and SW2 are arranged in the vicinities of the terminals T1 and T4, so that the distance between their source electrodes can be decreased. Therefore, the resistance of the transformer 13 and that of the conductor pattern of its peripheral circuit are expected to decrease.

Regarding the coil arrangement of the transformer 13, in the same manner as in FIGS. 4, 5A, and 5B, the intersections of the respective coils are dispersed between the upper and lower surfaces J and H. Thus, the winding width of a middle leg 101 (or columnar winding core) can be utilized more effectively. The respective terminals are arranged on the two surfaces of the printed-circuit board 14. As shown in FIG. 8, if the transformer 13 is buried in the opening 141 of the printed-circuit board 14, it can contribute to a decrease in profile of the circuit. If a conductive bar 12 is built into the printed-circuit board 14, the terminals T2 and T3 can be connected very easily.

Second Embodiment

A transformer 17 according to the second embodiment will be described. In the second embodiment, the same elements as those of the first embodiment are denoted by the same reference numerals, and a detailed description thereof will be omitted.

The transformer 17 is different from the transformer 13 of the first embodiment in the method of winding a coil 3. When the method of winding the coil 3 is changed, the positions and shapes of switching elements, lands, conductive patterns, and conductive bar 12 are also changed. These changes are not essential to this embodiment, and a detailed description thereof will accordingly be omitted.

Figure 11:
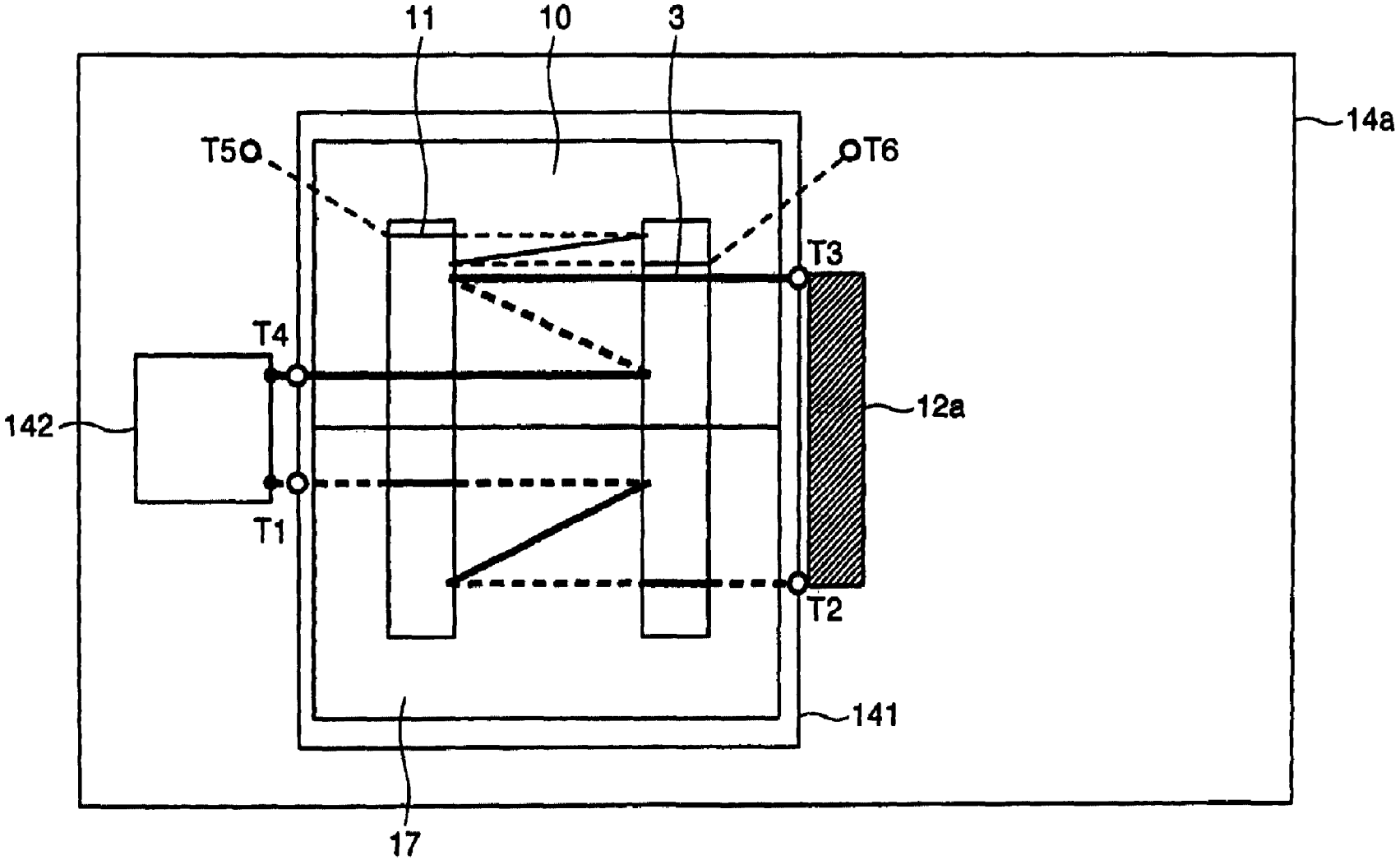
FIG. 11 is a view showing a printed-circuit board including a transformer according to the second embodiment.

FIG. 11 is a plan view of a printed-circuit board 14*a* including the transformer 17 of the second embodiment.

When FIGS. 8 and 11 are compared, although the winding direction of the coil 3 of the transformer 13 and that of the transformer 17 are the same, regarding the coil feeding direction by winding, the coil 3 of the transformer 13 is fed downward from above, while the coil 3 of the transformer 17 is fed upward from below. The coil feeding direction refers to the traveling direction of a winding when a corresponding coil is wound by fixing it at its winding start position. For example, when the winding start positions are at the terminals T4 and T1 shown in FIG. 11, the feeding direction of the coil 3 and that of the coil 2 are respectively upward and downward in FIG. 11.

When this winding method is employed, terminals T1 and T4 can be arranged much closer than in the transformer 13 of the first embodiment. This is very convenient when, e.g., realizing switching elements SW1 and SW2 with one chip. If the switching elements are buried in an opening portion 142 formed in the printed-circuit board 14*a*, in the same manner as in the transformer 17, they can be connected to the terminals T1 and T4 easily.

Conversely to FIG. 11, the terminals Ti and T4 may be connected to form a CT, and the switching elements SW1 and SW2 may be connected to the terminals T2 and T3. Then, connection (conductive bar 12) for forming the CT can be made as short as possible.

Third Embodiment

A transformer according to the third embodiment will be described. In the third embodiment, the same elements as those of the first and second embodiments are denoted by the same reference numerals, and a detailed description thereof will be omitted.

Figure 12:
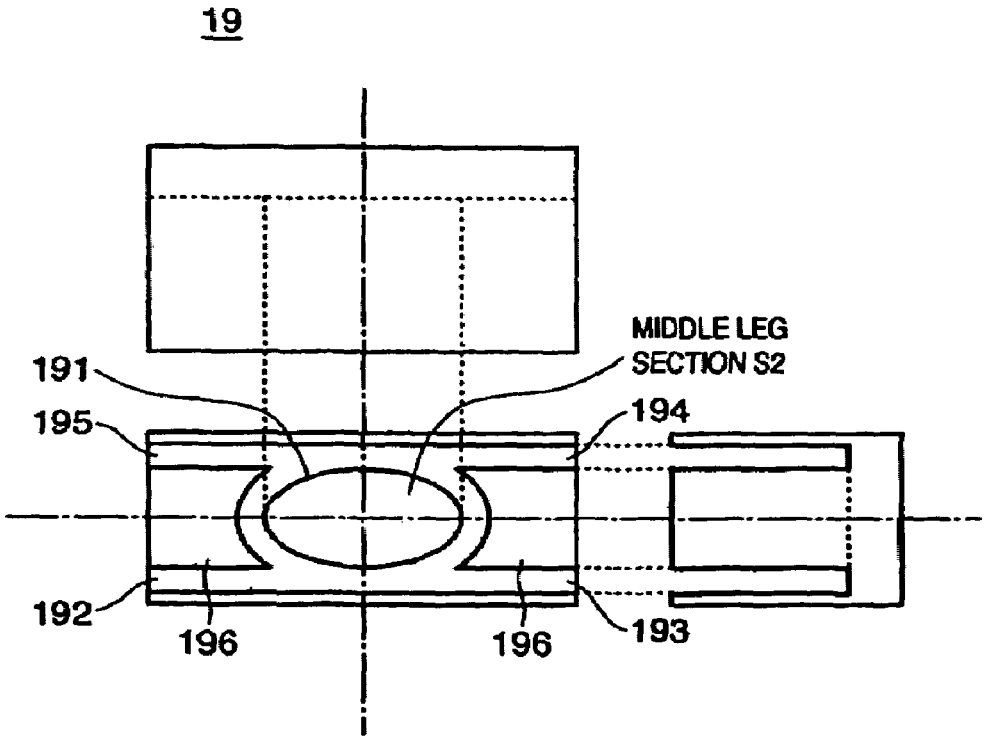
FIG. 12 is a view showing a core.

A transformer 24 according to the third embodiment uses cores 19 each shown in FIG. 12, which are different from the EE-type core of the transformer 17 of the second embodiment. When the EE-type core is changed to the core 19, the positions and shapes of switching elements, lands, conductive patterns, and conductive bar 12 are also changed. These changes are not essential to this embodiment, and a detailed description thereof will accordingly be omitted.

FIG. 12 is a trihedral view of the core 19. When the sections of the two cores 19 are mated, the two cores 19 form a core which has no opening portion other than four coil extracting ports 192 to 195. The core 19 has a middle leg 191 having an elliptic columnar shape, and two side legs 196.

Figure 13:
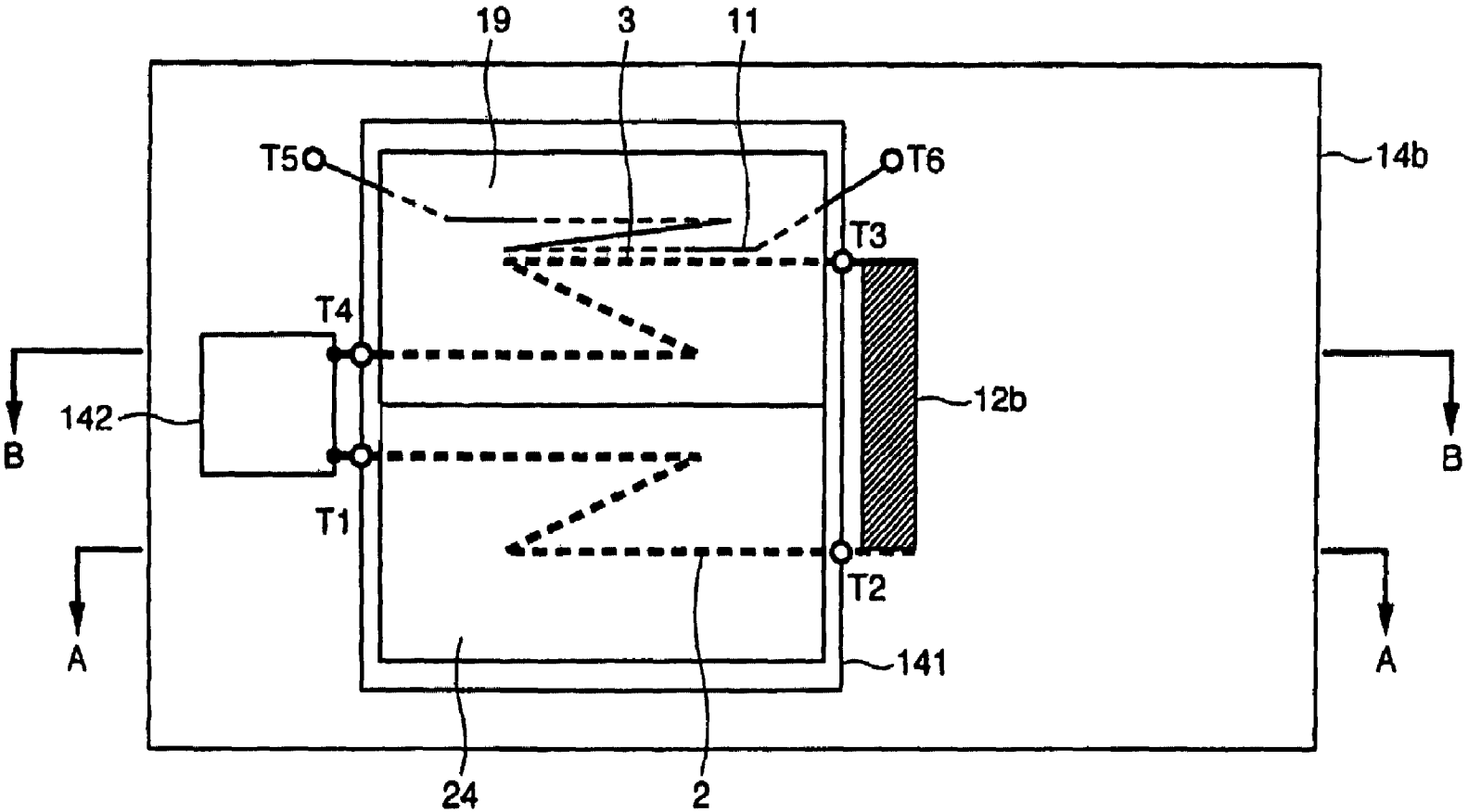
FIG. 13 is a view showing a printed-circuit board including a transformer according to the third embodiment.

FIG. 13 is a plan view of a printed-circuit board 14*b* including the transformer 24 of the third embodiment.

A method of winding coils 2 and 3 of the transformer 24 according to the third embodiment is the same as the method of winding the coils 2 and 3 according to the second embodiment. Hence, switching elements SW1 and SW2 are similarly arranged in an opening portion 142.

Figure 14:
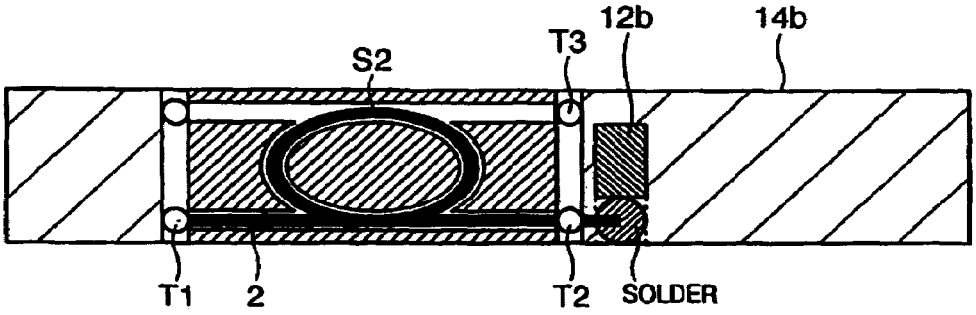
FIGS. 14 to 17 are views each for explaining a method of winding a coil when seen from a sectional side.
Figure 15:
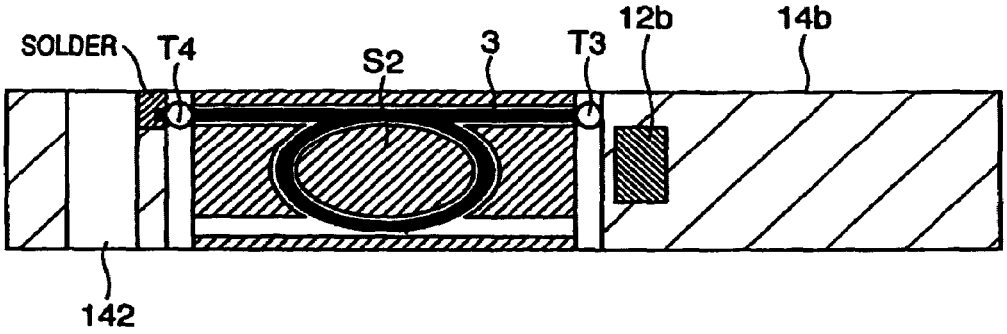

FIGS. 14 and 15 are sectional views taken along the lines A—A and B—B, respectively, of FIG. 13, and explain the method of winding the coils 2 and 3 when seen from the sectional sides. Although the coil 3 should be shown in the sectional view of FIG. 14, it is omitted for facilitating an explanation.

As shown in FIG. 14, the coil 2 corresponding to the coil 2 of the second embodiment enters the core 19 through the opening portion 192 shown in FIG. 12, is wound around the middle leg 191 counterclockwise with respect to a section S2 as the front, and comes out through the opening portion 193. Similarly, as shown in FIG. 15, the coil 3 corresponding to the coil 3 of the second embodiment enters the core 19 through the opening portion 195, is wound around the middle leg 191 clockwise, and comes out through the opening portion 194. The feeding directions of the coils 2 and 3 are the same as those in the second embodiment.

The ends (terminals T2 and T3) of the coils 2 and 3 are soldered to lands (see FIG. 14) in a recess formed in the printed-circuit board 14*b*, and are electrically connected to a conductive bar 12*b*. The remaining ends (terminals T1 and T4) are also soldered to lands (see FIG. 15) formed in the recess of the printed-circuit board 14*b*, and are electrically connected to the switching elements SW1 and SW2.

In this manner, in the same manner as in the second embodiment, the terminals T1 and T4 can be arranged close to each other. This is very convenient when, e.g., realizing the switching elements SW1 and SW2 with one chip. The transformer 24, including the coils, is completely buried in the printed-circuit board 14*b*. Thus, the entire circuit can be formed with a very low profile.

The sectional shape of the middle leg 191 is elliptic. When compared to the middle leg of, e.g., an EE-type core, not only the coils can be wound around the middle leg 191 easy, but also the entire lengths of the coils can be decreased (if the entire lengths are the same, the area of the section S2 can be increased). Therefore, a higher-efficient circuit can be formed.

In this manner, the coil winding method according to the present invention can be adopted regardless of the sectional shapes of the middle leg and columnar winding core.

When burying the transformer 24 in the printed-circuit board 14*b*, the ends (terminals T1 to T4) of the coils 2 and 3 may be bent in advance toward the lower or upper surface (that is, upward or downward in FIG. 14) of the printed-circuit board 14*b*. After the transformer 24 is built into the printed-circuit board 14*b*, the bent ends of the coils may be restored and be connected to the lands of the recess of the printed-circuit board 14*b*. According to another method, the printed-circuit board 14*b* is halved near, e.g., a plane B—B, and the transformer 24 is clamped by the divisional printed-circuit boards. A secondary coil 11 is extracted through any one of the opening portions 192 to 195 together with the coils 2 and 3, and is connected to the corresponding land described above.

The relationship between the combinations of the feeding directions and moving directions of the coils and the proportion of the winding widths of the coils in the columnar winding core will be described with reference to FIGS. 16 to 21.

Figure 16:
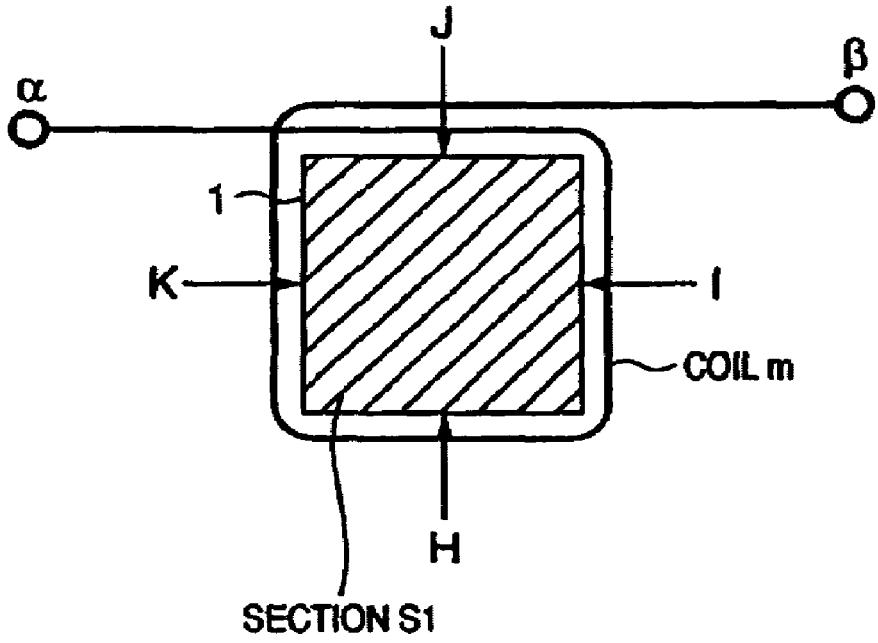
Figure 17:
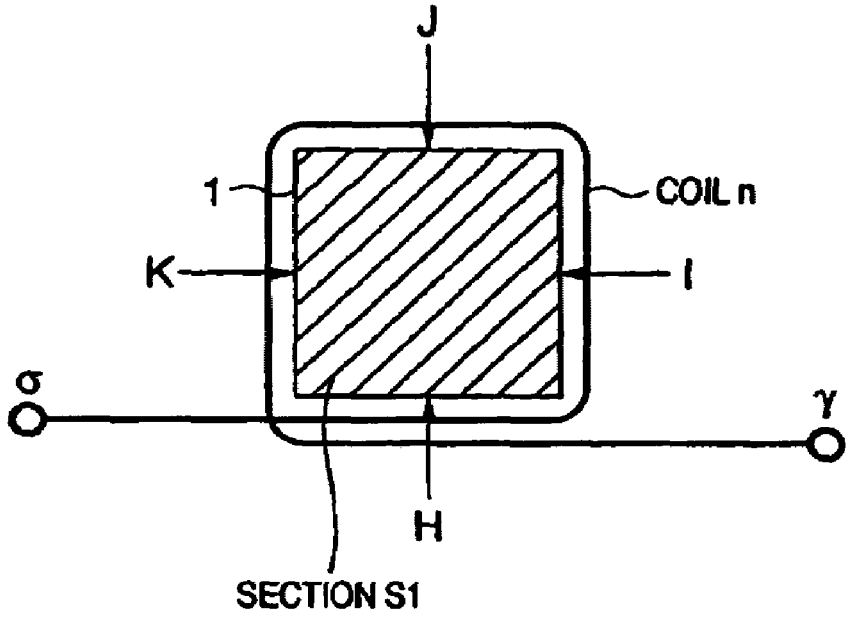

FIG. 16 is a view for explaining winding of a coil m wound around the columnar winding core 1 of FIG. 4. The coil m is fixed at its end a side, and is wound clockwise with respect to the section S1 as the front in the order of the upper surface J, side surface I, lower surface H, side surface K, and upper surface J by holding it at its end β side. FIG. 17 is a view for explaining winding of a coil n wound around the columnar winding core 1 of FIG. 4. The coil n is fixed at its end σ side, and is wound counterclockwise in the order of the lower surface H, side surface I, upper surface J, side surface K, and lower surface H by holding it at its end γ side.

Figure 18:
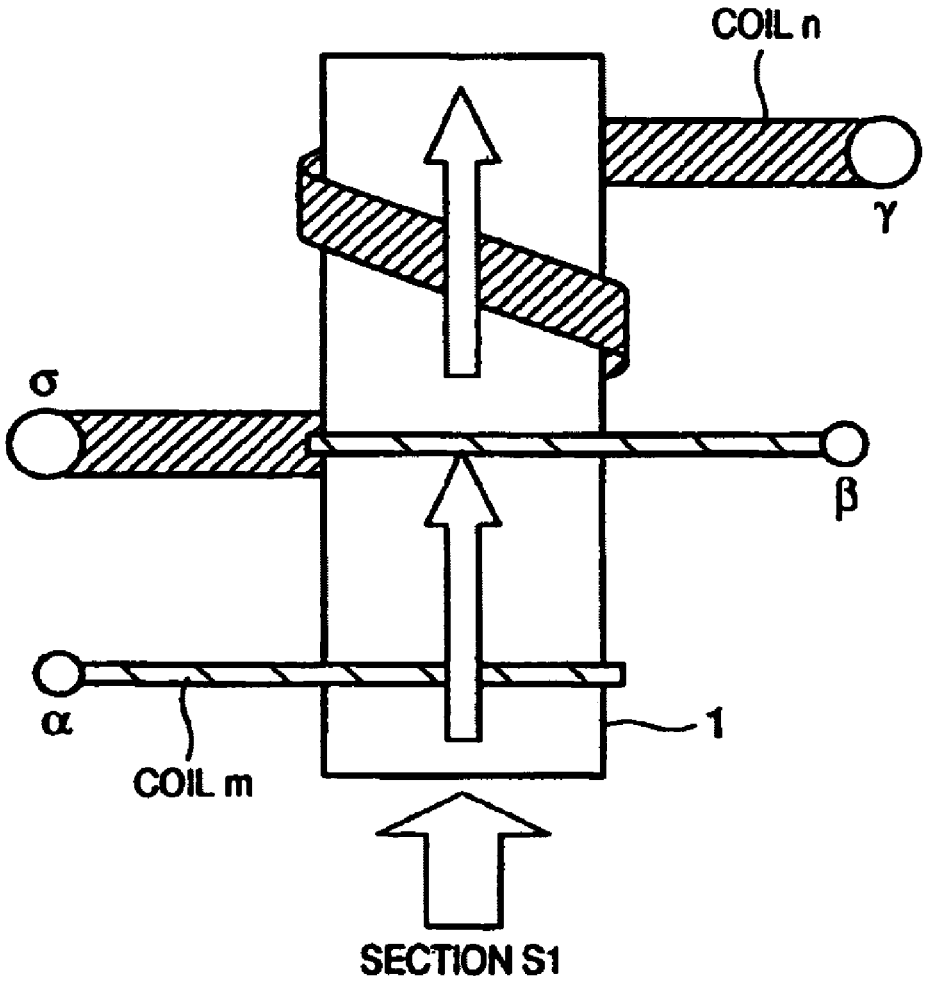
FIGS. 18 and 19 are views for explaining coil feeding directions.
Figure 19:
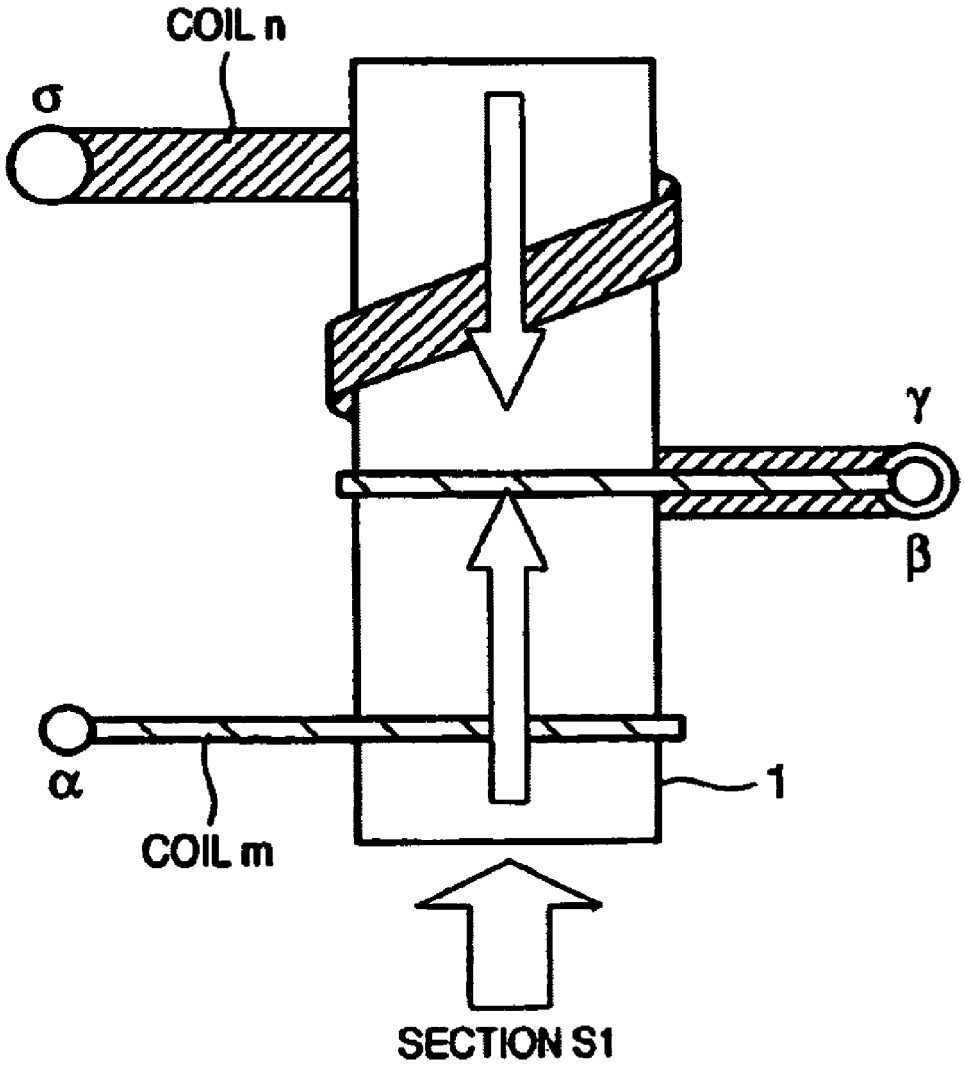

FIGS. 18 and 19 are views for explaining the feeding directions and moving directions of the respective coils wound around the columnar winding core 1, and are seen from above the columnar winding core 1.

In FIG. 18, the coils m and n are fed and moved in the same direction. In FIG. 19, the coils m and n are fed and moved in opposite directions.

Figure 20:
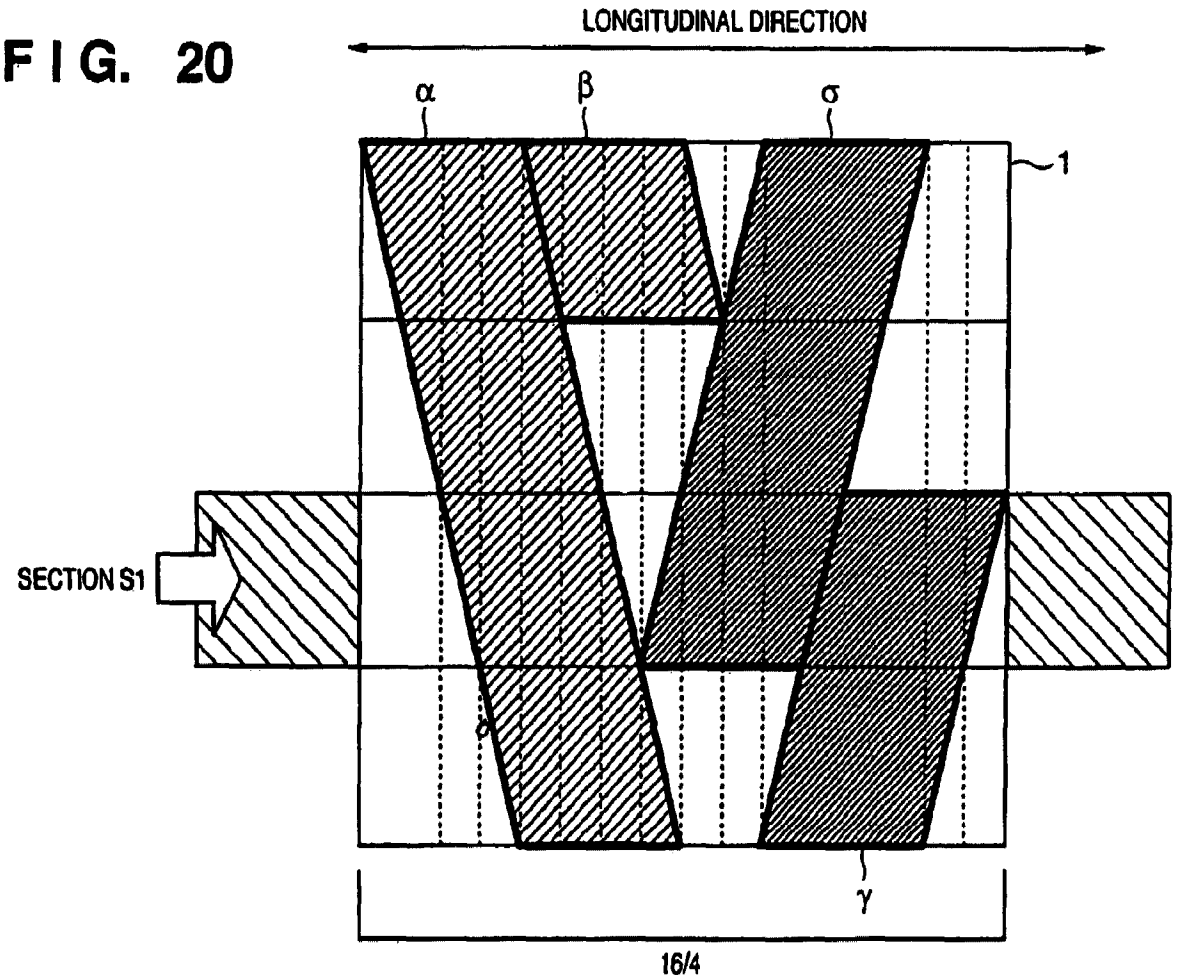
FIGS. 20 and 21 are developed views of a columnar winding core for explaining the traces of coils passing on the respective surfaces.
Figure 21:
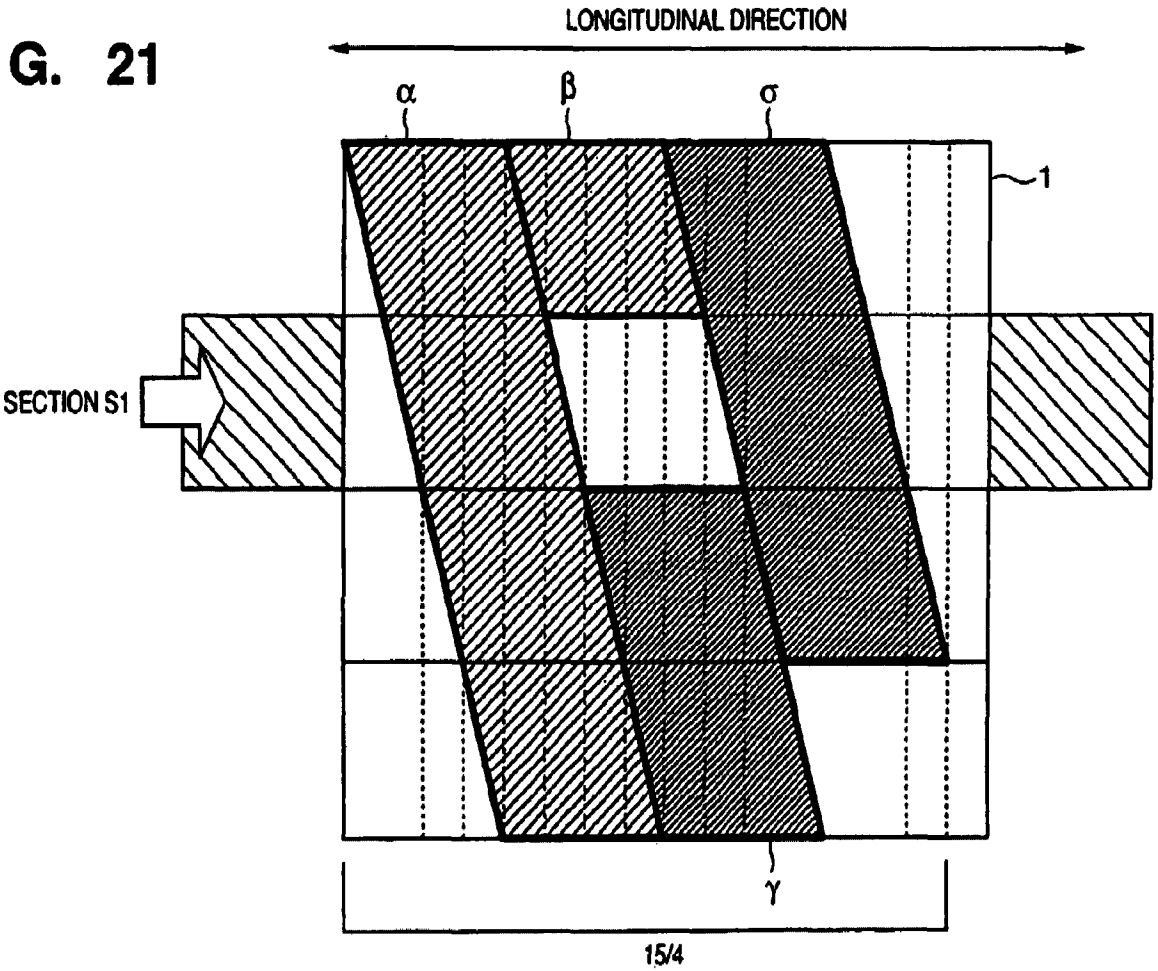

FIGS. 20 and 21 are developments of the columnar winding cores 1 shown in FIGS. 18 and 19, respectively, and explain the traces of the coils passing on the respective surfaces of the columnar winding cores 1. Each coil uses a flat square winding. The respective coils are wound such that no gap is formed between the coils in the longitudinal direction of the columnar winding core 1.

As shown in FIG. 20, when the coils m and n are fed and moved in the same direction, the width in the longitudinal direction of the columnar winding core 1 occupied by the coils m and n is four times the width of one winding. As shown in FIG. 21, when the coils m and n are fed and moved in the opposite directions, the width in the longitudinal direction of the columnar winding core 1 occupied by the coils m and n is 15/4 times the width of one winding. Therefore, when the feeding and moving directions of the coils are reversed, the widthwise direction of the columnar winding core 1 can be utilized more effectively by an amount corresponding to 1/4 the width of one winding.

In this manner, the transformer (or inductor) according to this embodiment is characterized in that the first coil is wound around the leg or winding core of the core, the second coil is wound in a winding direction opposite to that of the first coil, and different-polarity ends of the first and second coils are extracted on one side surface of the leg or winding core of the core.

According to this arrangement, the different-polarity ends of the coils extracted on one side surface of the leg or winding core of the core form a center tap. Those ends of the coils which are extracted on the other side surface can be connected to the switching elements. Thus, the conductive patterns or members for forming the center tap can be shortened. A plurality of switching elements can be arranged in a narrower region. Thus, the resistance of the transformer and that of its peripheral circuit can be decreased.

As the intersections of the first and second coils are not located on one surface of the leg or winding core of the core, the winding width of the leg or winding core of the core can be utilized more effectively.

When burying the transformer (or inductor) in the printed-circuit board, if the ends of the respective coils are arranged on the two surfaces of the printed-circuit board, the entire lengths of the coils are minimized. This is optimal for an arrangement in which the transformer (or inductor) is to be buried in the printed-circuit board. This arrangement naturally contributes to a decrease in profile of the entire circuit. Furthermore, if a conductive bar is built into the printed-circuit board, those ends of the coils which form a center tap can be connected very easily.

As many apparently widely different embodiments of the present invention can be made without departing from the spirit and scope thereof, it is to be understood that the invention is not limited to the specific embodiments thereof except as defined in the appended claims.

What is claimed is:

1. An electric component which is a transformer for a push-pull switching circuit, comprising:

a winding core;

a first coil wound round said winding core;

a second coil wound around said winding core in a direction opposite to that of said first coil; and a third coil wound around said winding core, wherein ends of said first and second coils with different polarities are extracted on one side of said winding core, and feeding directions for winding said first and second coils are different from each other, and wherein said first and second coils are primary coils and insulate from said third coil, which is a secondary coil.

2. The component according to claim 1, wherein a number of turns of each of said first and second coils is 1.

3. An electric component, which is a transformer for a push-pull switching circuit, with a printed-circuit board, comprising:

a winding core;

a first coil wound around said winding core; and a second coil wound round said winding core in a direction opposite to that of said first coil, wherein ends of said first and second coils having different polarities are extracted on one side of said winding core, and wherein the printed-circuit board has an opening portion for said winding core and coils, and has terminals for a center-tap of the push-pull switching circuit, to connect to the ends of said coils.

4. The component with the printed-circuit board according to claim 3, wherein said terminals are arranged on two surfaces of said printed-circuit board.

5. The component with the printed-circuit board according to claim 3, wherein the printed-circuit board has a connecting member which feeds through said printed-circuit board and electrically connects said terminals arranged on two surfaces of said printed-circuit board.

6. The component according to claim 3, wherein said winding core is a columnar body.

* * * * *

UNITED STATES PATENT AND TRADEMARK OFFICE

CERTIFICATE OF CORRECTION

PATENT NO. : 7,295,095 B2
APPLICATION NO. : 10/834890
DATED : November 13, 2007
INVENTOR(S) : Suzuki It is certified that error appears in the above-identified patent and that said Letters Patent is hereby corrected as shown below:

COLUMN 5:
Line 59, “arranged” should read -- arranged on --.

COLUMN 6:
Line 50, “Ti” should read -- T1 --.

COLUMN 7:
Line 49, “easy,” should read -- easily, --.

COLUMN 8:
Line 11, “a” should read -- α --.

COLUMN 9:
Line 18, “round” should read -- around --.

COLUMN 10:
Line 8, “round” should read -- around --.

Signed and Sealed this

Twenty-fourth Day of June, 2008

JON W. DUDAS
*Director of the United States Patent and Trademark Office*